United States Patent [19]

Swain et al.

[11] Patent Number: 4,526,516

[45] Date of Patent: Jul. 2, 1985

[54] VARIABLE CAPACITY WOBBLE PLATE COMPRESSOR CAPABLE OF CONTROLLING ANGULARITY OF WOBBLE PLATE WITH HIGH RESPONSIVENESS

[75] Inventors: James C. Swain, Columbus; Jan B. Yates, Reynoldsburg, both of Ohio

[73] Assignee: Diesel Kiki Co., Ltd., Tokyo, Japan

[21] Appl. No.: 467,404

[22] Filed: Feb. 17, 1983

[51] Int. Cl.[3] ..... F04B 1/26; F04B 1/28

[52] U.S. Cl. ..... 417/222; 417/270; 92/12.2

[58] Field of Search ..... 417/218, 222, 270; 92/12.2

[56] References Cited

U.S. PATENT DOCUMENTS

| | | | |
|---|---|---|---|
| 2,053,593 | 9/1936 | Ziska et al. | 417/458 |
| 3,302,585 | 2/1967 | Adams et al. | 417/222 |
| 3,861,829 | 1/1975 | Roberts | 417/270 |
| 4,145,163 | 3/1979 | Fogelberg | 417/222 |
| 4,428,718 | 1/1984 | Skinner | 417/270 |
| 4,432,703 | 2/1984 | Beutler | 417/218 |

*Primary Examiner*—William L. Freeh

*Attorney, Agent, or Firm*—Charles S. McGuire

[57] ABSTRACT

A wobble plate compressor, which is adapted to vary the angularity of the wobble plate in response to the difference between the resultant reaction force exerted by the pistons on their compression strokes and the pressure in the crankcase, includes elastic means permanently biasing the wobble plate in the angularity-decreasing direction, and control valve means responsive to a signal indicative of at least one predetermined parameter to selectively connect the crankcase with a suction pressure space and a discharge pressure space for a rapid change in the pressure in the crankcase to thereby achieve control of the angularity of the wobble plate with high responsiveness.

4 Claims, 8 Drawing Figures

VARIABLE CAPACITY WOBBLE PLATE COMPRESSOR CAPABLE OF CONTROLLING ANGULARITY OF WOBBLE PLATE WITH HIGH RESPONSIVENESS

BACKGROUND OF THE INVENTION

This invention relates to variable capacity wobble plate compressors mainly adapted for use in air conditioning systems for automotive vehicles, and more particularly to an improved wobble plate compressor wherein the pressure in the crankcase is controllable for varying the displacement or capacity of the compressor.

A variable capacity wobble plate compressor in general is adapted to vary its displacement or capacity through a change in the angularity of the wobble plate. It is known e.g. from U.S. Pat. No. 3,861,829 to vary the refrigerant pressure in the crankcase for changing the angularity or angle of inclination of the wobble plate relative to the drive shaft. According to this patented invention, the compressor comprises a fluidtight housing, a drive shaft rotatably disposed in the housing, a cylinder block disposed in the housing and formed therein with a plurality of cylinders circumferentially arranged around the drive shaft and extending substantially parallel to the axis of the drive shaft, pistons received in the cylinders for reciprocating motions therein, and a wobble plate supported at its central portion by a trunnion pin extending perpendicularly to the drive shaft and axially movable therealong and also supported at its peripheral edge by a pivot rotatable about the drive shaft in unison therewith. The wobble plate is adapted to be pivotally displaced in unison with axial movement of the trunnion pin along the drive shaft to have its angularity varied relative to the drive shaft. As the wobble plate rotates in a position inclined relative to the drive shaft, the pistons are reciprocatingly moved in their respective cylinders for pumping actions. In this compressor, the resultant reaction force exerted by all the pistons on their compression strokes acts upon the wobble plate at a point inside a half portion of the circumference described by the axes of the cylinders, which is located at an opposite side of the drive shaft to the pivot point about which the wobble plate pivots, so that the wobble plate is permanently acted upon by the above resultant reaction force to become inclined relative to the drive shaft about the pivot point during the pumping actions of the pistons. The resultant reaction force of the pistons counteracts the pressure in the crankcase which acts upon the pistons as back pressure. Therefore, when there occurs a drop in the pressure in the crankcase, the wobble plate is displaced to increase the capacity in the angularity-increasing direction, whilst when there occurs an increase in the crankcase pressure, the wobble plate is displaced in the angularity-decreasing direction to decrease the capacity.

In the conventional wobble plate compressor described above, a diaphram valve is arranged across a line connecting the crankcase with a zone under lower pressure in the refrigerating circuit of an air conditioner, and operable in response to the refrigerant pressure in the line so that when a drop occurs in the line pressure due to a decrease in the thermal load on the refrigerating circuit, the valve is displaced to restrict the communication between the crankcase and the lower pressure zone in the refrigerating circuit to reduce the flow rate of blow-by gases which are leaked into the crankcase through gaps between the cylinders and the pistons, to the line, resulting in an increase in the crackcase pressure. Consequently, the angularity of the wobble plate decreases to reduce the displacement of the compressor. On the contrary, when the crankcase pressure rises due to an increase in the thermal load on the refrigerating circuit, the crankcase pressure decreases to cause an increase in the angularity of the wobble plate to obtain an increased displacement of the compressor.

In this arrangement, if the crankcase pressure is variable within a range from 5 to 10 percent of the difference between the suction pressure and discharge pressure of the compressor and the former is 30 psig, and the latter 200 psig, for instance, the crankcase pressure is limited within a range from 38.7 to 47 psig. Therefore, the conventional wobble plate control suffers from low responsiveness. This is particularly disadvantageous in the event that it is desired to suddenly reduce the displacement of the compressor, for instance when it is desired to temporarily relieve an automotive engine associated with the compressor of the compressor load to use the total engine output for driving the automotive vehicle on which the engine is installed, in accelerating the vehicle or when the vehicle is running on an ascending slope.

Furthermore, according to the conventional arrangement, the wobble plate angularity control also has low responsiveness to a change in the engine speed. That is, when a sudden change takes place in the engine speed, there occurs a change in the crankcase pressure due to a corresponding change in the amount of blow-by gases produced, followed by a change in the angularity of the wobble plate and also changes in the suction pressure and discharge pressure to vary the opening of the diaphragm valve, which determines the final crankcase pressure to set the wobble plate to a corresponding angular position.

OBJECTS AND SUMMARY OF THE INVENTION

It is a primary object of the invention to provide a variable capacity wobble plate compressor in which high discharge pressure and low suction pressure are selectively introduced directly into the crankcase for control of the angularity of the wobble plate to thereby achieve the angularity control with high responsiveness.

It is a further object of the invention to provide a variable capacity wobble plate compressor which includes feedback means adapted to directly detect the angularity of the wobble plate and a control valve controlled by the feedback means responsive to the detected angularity, to thereby further improve the angularity control responsiveness and accuracy.

It is a still further object of the invention to provide a variable capacity wobble plate compressor which is adapted to produce required suction pressure and discharge pressure immediately upon starting of the operation, to permit immediate initiation of automatic control of the displacement of the compressor.

It is another object of the invention to provide a variable capacity wobble plate compressor which permits proper automatic control of the operation of an air conditioner in which the compressor is used, responsive to a signal indicative of one or more parameters related to the operation of the air conditioner, to thereby maintain a comfortable airconditioned ambience.

It is also an object of the invention to eliminate the clutch for drivingly connecting or disconnecting the compressor with a prime mover.

A variable capacity wobble plate compressor according to the present invention is provided with elastic means permanently applying biasing force to the wobble plate in the angularity-decreasing direction, and control valve means responsive to a signal indicative of at least one predetermined parameter to selectively connect the crankcase with a suction pressure space and a discharge pressure space, to decrease the pressure in the crankcase for an increase in the angularity of the wobble plate when the crankcase is connected with the suction pressure space and to increase the crankcase pressure for a decrease in the angularity when the crankcase is connected with the discharge pressure space.

Preferably, the control valve means comprises a spool valve having a spool displaceable for selectively establishing the communication of the crankcase with the suction pressure space and the discharge pressure space, solenoid means operable when energized to displace the spool of the spool valve in a direction of establishing the communication of the crankcase with the suction pressure space, feedback means operable to displace the spool of the spool valve in a direction of establishing the communication of the crankcase with the discharge pressure space, with its displacing force variable in response to the angularity of the wobble plate, and electronic means for energizing the solenoid with a magnitude corresponding to the value of the above parameter signal.

Preferably, the wobble plate compressor according to the invention includes a check valve arranged at the outlet of the discharge pressure space for opening when the pressure in the same space exceeds a predetermined value, and the pistons are disposed to make reciprocating motions through a slight stroke length sufficient for producing in the suction pressure space and the discharge pressure space suction pressure and discharge pressure required for the above control valve means to carry out the control of the angularity of the wobble plate when the wobble plate assumes a predetermined minimum angularity.

The above and other objects, features and advantages of the invention will be more apparent from the ensuing detailed description taken in connection with the accompanying drawings in which:

DETAILED DESCRIPTION

The present invention will be described with reference to the drawings which show an embodiment of the invention.

Figure 1:
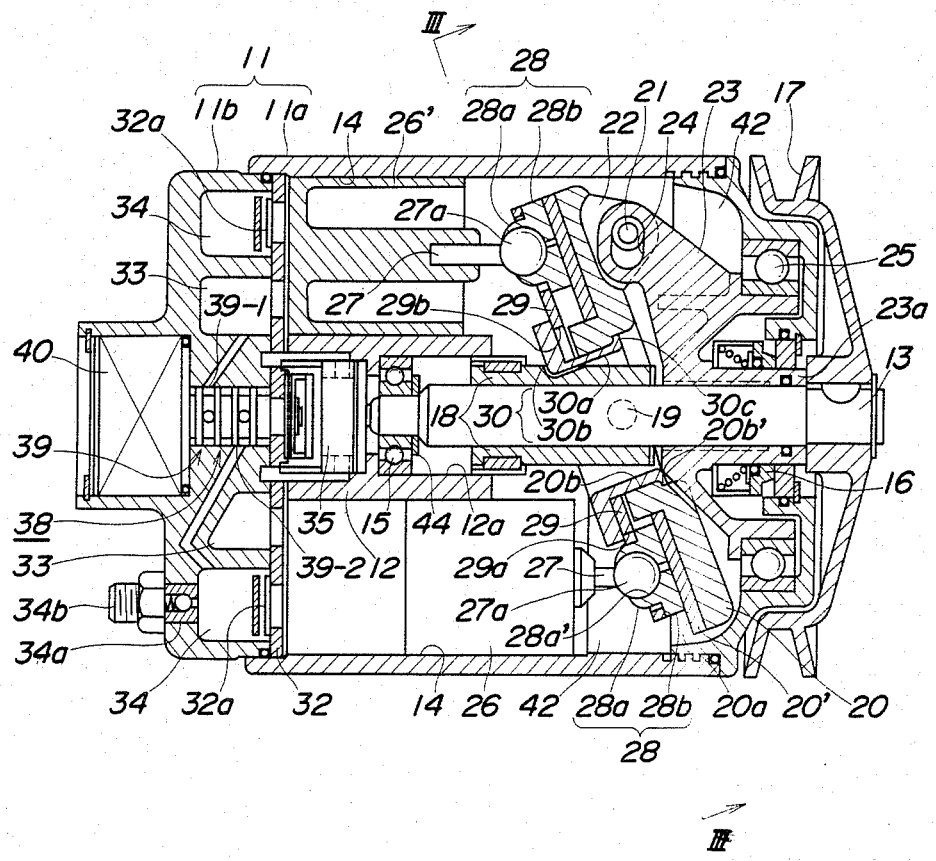
FIG. 1 is a horizontal longitudinal sectional view of a variable capacity wobble plate compressor according to an embodiment of the present invention.
Figure 2:
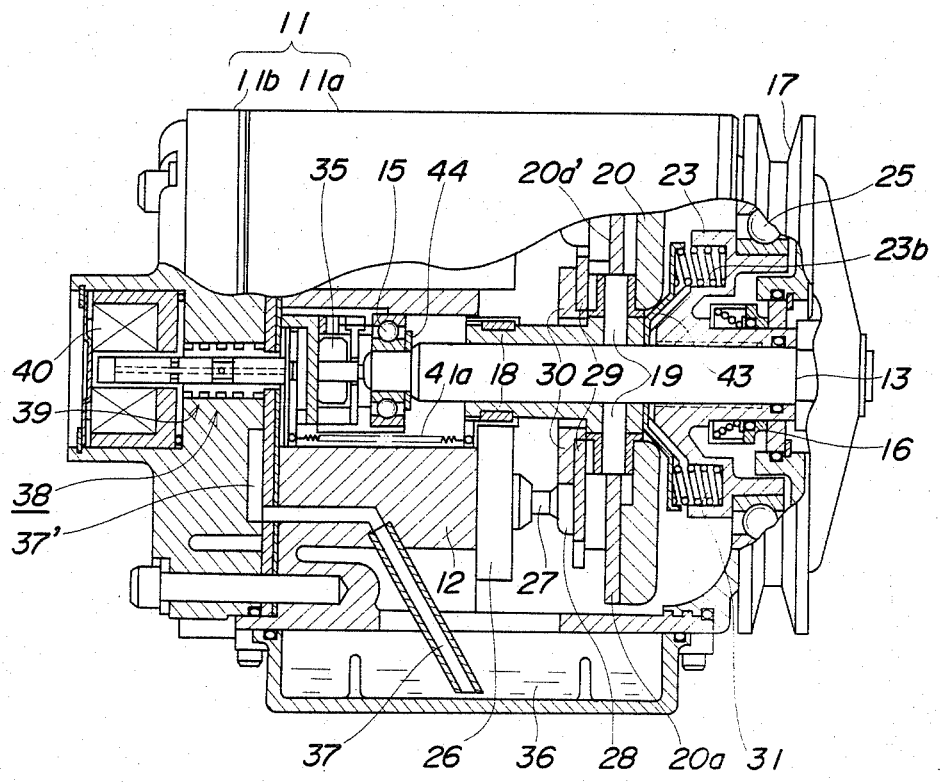
FIG. 2 is a vertical longitudinal sectional view of the same compressor.

Referring first to FIGS. 1 and 2, there is shown the whole construction of a variable capacity wobble plate compressor according to the invention. The compressor is described hereinbelow as applied to an air conditioning system for automotive vehicles. Reference numeral 11 designates a housing which is formed by a cylindrical casing 11*a* and a cylinder head 11*b* combined together. A cylinder block 12 is disposed within the cylindrical casing 11*a*, which may be formed integrally on the casing 11*a* and which is formed therein with a plurality of cylinders 14 circumferentially arranged around a drive shaft 13 and extending substantially parallel to the axis of same. A crankcase 42 is defined in the housing 11 by an inner end of the cylinder block 12 and inner walls of the casing 11*a*. The drive shaft 13 is disposed substantially along the longitudinal axis of the housing 11, with its one end journalled by a ball bearing 15 mounted in a central bore 12*a* formed in the cylinder block 12 and its other end extending through a front portion of the casing 11*a* which is located on the right side as viewed in FIG. 1, and carrying a pulley 17 rigidly fitted thereon. A slider 18 in the form of a sleeve is fitted on the drive shaft 13 for axial sliding movement thereon, on which are secured a pair of trunnion pins 19 extending at right angles to the drive shaft 13. A wobble plate 20 in the form of a disc is loosely fitted on the slider 18 at its central through bore 20*b* and pivotally engages with the latter in a manner that the trunnion pins 19 are rotatably fitted in bores, not shown, formed in the inner peripheral wall of the central through bore 20*b* of the wobble plate 20. Thus, as the slider 18 axially moves along the drive shaft 13, the wobble plate 20 is moved along the same shaft in unison with the slider 18 to be tilted about the trunnion pins 19 with respect to the drive shaft 13. In the illustrated embodiment, a disc plate 20' is secured on or slidably applied on a side surface of the wobble plate 20, which is formed of a material having a high wear resistance.

A pivot 21 is mounted on the wobble plate 20 by means of a bracket 22, at a side of the wobble plate 20 remote from the cylinder block 12 at a location in the vicinity of a point on an extension of the axis of a particular one of pistons 26 received in the cylinders 14. The pivot 21 is engaged in a guide bore 24 formed in a pivot hub 23 which is rigidly secured at its boss 23*a* on the drive shaft 13 for rotation in unison with the latter, so that rotation of the drive shaft 13 is transmitted to the wobble plate 20 through the members 23, 21, 22 and 19 to cause corresponding rotation of the wobble plate 20 and the wobble plate 20 can be tilted about the pivot or fulcrum 21 along an orbital path executed by the trunnion pins 19 as the slider 18 moves along the drive shaft 13. The pivot hug 23 is journalled by a large-sized ball bearing 25 mounted on the casing 11*a* in a manner that the front portion of the drive shaft 13 is substantially supported by the casing 11*a* by means of the ball bearing 25 via the pivot hub 23. A sealing assembly 16 is slidably fitted on the boss 23*a* of the pivot hub 23 and secured to the casing 11*a*.

Coil springs 31 are compressedly mounted in recesses 23*b* formed in an inner end of the pivot hub 23 and permanently urge the slider 18 through a dished member 43 in the leftward direction as viewed in FIG. 2 so that the wobble plate 20 tends to be biased in the angularity-decreasing direction. On the other hand, a stopper 44 is rigidly fitted on a rear end of the drive shaft 13 facing the cylinder block 12, which is brought into contact with the ball bearing 15 rigidly fitted in the central bore 12*a* for determining a minimum angularity of the wobble plate 20. The pistons 26 are each arranged to make a reciprocating motion in its corresponding cylinder 14 through a stroke length equal to several percent of its maximum stroke length when the wobble plate is in its minimum angularity position determined by the stopper 44.

A valve plate 32 is mounted at an outer end of the cylinder block 12, which carries thereon suction valves, not shown, and discharge valves 32*a* at locations corresponding to their respective cylinders 14. The suction valves are arranged between the cylinder bores and an annular suction chamber 33 formed in the cylinder head 11*b*, and the discharge valves 32*a* between the cylinder bores and an annular discharge chamber 34 formed in the same head 11*b*, respectively. The discharge chamber 34 is provided with a check valve 34*a* at its outlet, which opens when the pressure in the chamber 34 exceeds a predetermined value, and the chamber 34 can communicate through the same valve 34*a* with an outlet port formed in a discharge connector 34*b* which is to be connected to the refrigerating circuit, not shown, of the air conditioner.

Figure 3:
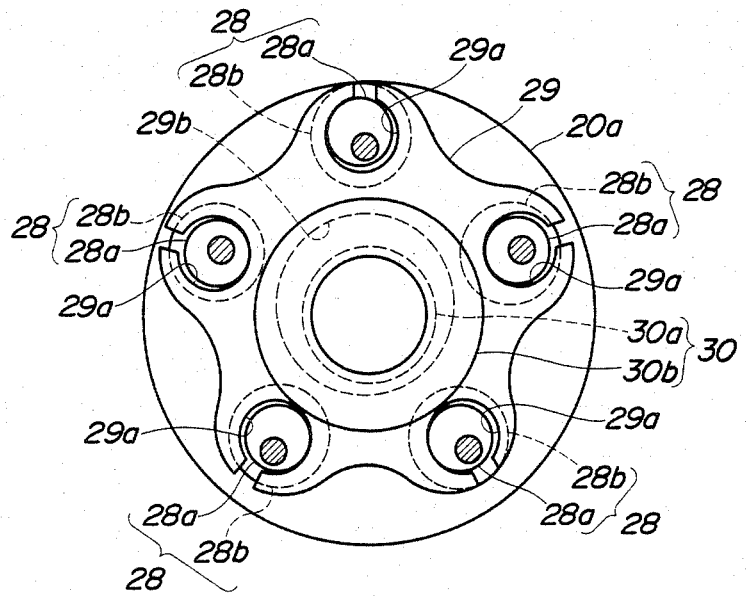
FIG. 3 is an end view taken along line III—III in FIG. 1.

On the other hand, the aforementioned pistons 26 are received in the cylinders 14 for reciprocating motions therein, which cylinders are arranged in an array concentric to the axis of the drive shaft 13. A piston rod 27 is secured integrally on each piston 26 and extends along an extension of 10 the axis of same toward the wobble plate 20. The piston rods 27 each have a tip formed integrally with a sphere 27*a* which is spherically engaged in a bore 28*a' formed in a trunk portion 28a* of a corresponding slipper shoe 28 for allowing the slipper shoe 28 to swing about the center of the sphere 27*a*. The slipper shoes 28 each have a flanged portion 28*b* permanently held in slidable contact or close proximity with a sliding side surface 20*a* of the wobble plate 20 even during rotation of the latter, by the following means: As seen in FIG. 3 showing a view taken along the line III—III in FIG. 1, a first retainer member 29 in the form of an annular plate is formed with five through bores 29*a* circumferentially arranged in the vicinity of its outer peripheral edge at locations corresponding to respective ones of the slipper shoes 28 spherically engaging the spheres 27*a* on the tips of the piston rods 27, each through bore 29*a* being slightly larger in diameter than the trunk portion 28*a* of its associated slipper shoe 28. The illustrated piston pump is a five-cylinder type. The first retainer member 29 is also formed with a central through bore 29*b* considerably larger in diameter than the drive shaft 13 and loosely fitted on the latter. The slipper shoes 28 have their trunk portions 28*a* loosely fitted in their respective through bores 29*a* of the first retainer member 29 and their flanged portions 28*b* disposed in slidable contact or close proximity with the same member 29, respectively, in such a manner that as the slipper shoes 28 slidingly move on the wobble plate 20, the first retainer member 29 can be freely moved in directions substantially parallel to the sliding side surface 20*a* of the wobble plate 20. The first retainer member 29 has outer peripheral edges 29*c* intermediate between adjacent through bores 29*a* radially inwardly concaved to reduce the whole weight of the member 29. Each of the through bores 29*a* has a narrow cut-out portion 29*a'* opening in the outer peripheral surface of the first retainer member 29, through which portion the corresponding piston rod 27 engaged in the corresponding slipper shoe 28 is inserted into the through bore 29*a* in putting the slipper shoe-piston rod assembly and the first retainer member 29 together.

A second retainer member 30 is provided for holding the first retainer member 29 on the slipper shoes 28 to keep the slipper shoes 28 in slidable contact or close proximity with the sliding side surface 20*a* of the wobble plate 20. The second retainer member 30 comprises an axially extending hollow tubular portion 30*a* loosely fitted in the central through bore 29*b* of the first retainer member 29 and also unremovably fitted in the central through bore 20*b* of the wobble plate 20 with its radially outwardly deformed flange 30*c* engaged by a stepped shoulder 20*b'* formed on the central through bore 20*b* of the wobble plate 20, and a radially flanged portion 30*b* formed integrally on an end of the hollow tubular portion 30*a* and larger in diameter than the central through bore 29*b* of the first retainer member 29 but so small in diameter that it does not interfere with movement of the associated slipper shoes 28 on the wobble plate 20. The second retainer member 30 has its flanged portion 30*b* disposed to hold the first retainer member 29 in slidable contact or close proximity with the slipper shoes 28 while allowing an inner fringe portion of the first retainer member 29 surrounding its central bore 29*b* to slide on the flanged portion 30*b*.

An oil pump 35 is arranged in the cylinder block 12 and coupled to the rear end of the drive shaft 13 to be rotatively driven by the latter during its rotation to suck up lubricant oil from an oil sump 36 provided at the bottom of the casing 11*a* through a pipe 37*a* and a passage 37*b* and feed same to various sliding portions of the compressor.

Figure 8:
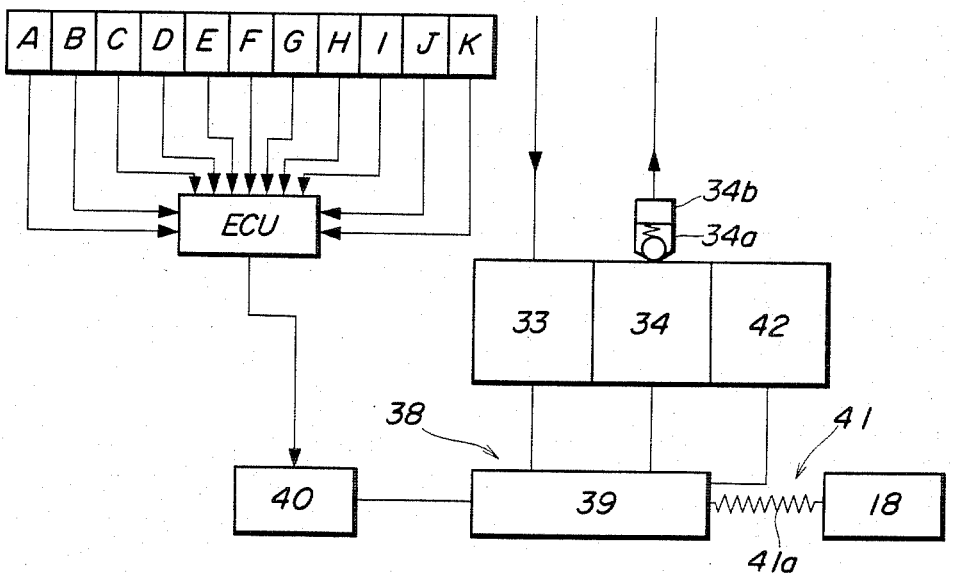
FIG. 8 is a block diagram showing the connection between the control valve and its related parts.

A control valve assembly 38 is arranged in the cylinder head 11*b* at a location essentially on an extension of the axis of the drive shaft 13. This control valve assembly 38 comprises a a spool valve 39, a solenoid 40 responsive to a control signal to bias the spool 39*a* of the spool valve 39 in the direction of increasing the angularity of the wobble plate 20, and a feedback means 41 adapted to detect the angularity of the wobble plate 20 for biasing the spool 39*a* in the direction of decreasing the angularity of the wobble plate 20 in response to the detected angularity. As shown in detail in FIG. 4, the spool valve 39 comprises an axial bore 39*b* formed through the cylinder head 11*b* at a location on an extension of the axis of the drive shaft 13, a first port 39-1 opening in the bore 39*b* and communicating with the suction chamber 33, a second port 39-2 opening in the bore 39*b* and communicating with the discharge chamber 34, and a spool 39*a* slidably received in the bore 39*b*. The spool 39*a* is formed with a first land 39-3, a first annular groove 39-4, a second land 39-5, a second annular groove 39-6, and a third land 39-7 axially arranged in 30 the order mentioned. An internal bore 39-8 axially extends in the spool 39*a* through at least a portion corresponding to the first annular groove 39-4, the second land 39-5, the second annular groove 39-6 and the third land 39-7. The spool 39*a* is further formed with third and fourth ports 39-9 and 39-10 opening in the bottoms of the first and second annular grooves 39-4 and 39-6, respectively, and communicating with the internal bore 39-8. The end of the spool 39*a* formed with the first land 39-3 is coupled to the output element, not shown, of the solenoid 40, and the internal bore 39-8 opens in the end face of the other end formed with the third land 39-7 and communicates with the crankcase 42 in the housing 11. The above third land-formed end of the spool 39*a* is coupled to one end of a spring 41*a* comprising the feedback means 41, the opposite end of which is coupled to the slider 18. The solenoid 40 is electrically connected to an electronic control unit ECU to be energized or deenergized by a control signal supplied from the latter and has a value corresponding to the value of at least one of signals A through K, hereinafter described in detail, inputted to the electronic control unit ECU. Responsive to energization of the solenoid 40, the spool valve 39 is actuated for varying the angularity of the wobble plate 20 to control the capacity of the compressor. The electronic control unit ECU is connected to the power switch, not shown, of the air conditioner to be supplied with supply voltage through the power switch. The connection of the control valve assembly 38 with its related parts is shown in FIG. 8.

Figure 4:
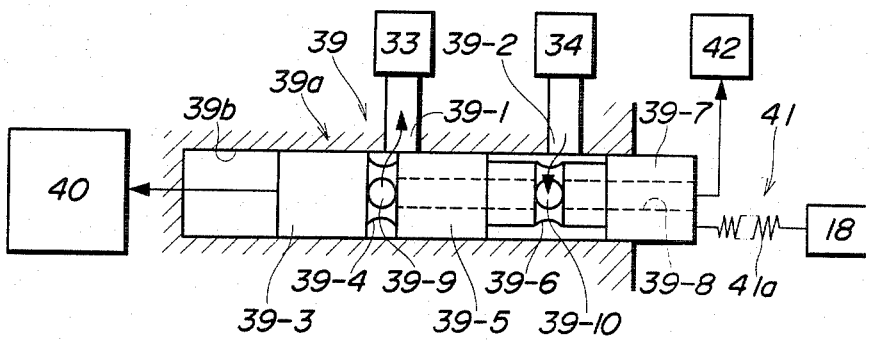
FIG. 4 is a schematic view showing a control valve arrangement provided in the compressor according to the invention, wherein the control valve is in a bypassing position.

The operation of the compressor arranged above will now be described. When the power switch of the air conditioner is opened wherein the compressor is at rest or idling, the electronic control unit ECU of the control valve assembly 38 is then inoperative and acccordingly the solenoid 40 is in a deenergized state. Therefore, the slider 18 is biased in urging contact with the stopper 18*a* by the urging force of the spring 31, to keep the wobble plate 20 in its minimum angularity position. At the same time, due to the deenergization of the solenoid 40, the spool 39*a* of the spool valve 39 is biased in a bypassing position as shown in FIG. 4, by the pulling force of the feed-back spring 41*a*, wherein the first port 39-1 leading to the suction chamber 33 communicates with the third port 39-9 in the first annular groove 39-4, and the second port 39-2 leading to the discharge chamber 34 with the fourth port 39-10 in the second annular groove 39-6, respectively, so that the crankcase 42 communicates with both the suction chamber 33 and the discharge chamber 34 through the internal bore 39-8 in the spool 39*a*. With the spool 39*a* on this position, the check valve 34*a* at the outlet of the discharge chamber 34 is kept in its closed position by the force of its own spring. If the wobble plate 20 rotates on this occasion, recirculation of refrigerant gas takes place in unison with reciprocating motions of the pistons 26, within a closed circuit formed by the cylinder bores, the suction chamber 33, the discharge chamber 34, the crankcase 42 and the passageway communicating the latter three chambers 33, 34 and 42 with each other, since the wobble plate 20 is then in its minimum angularity position wherein the pistons 26 are caused to make stroke motions through a stroke length equal to several percent of the maximum stroke length as previously mentioned.

Figure 5:
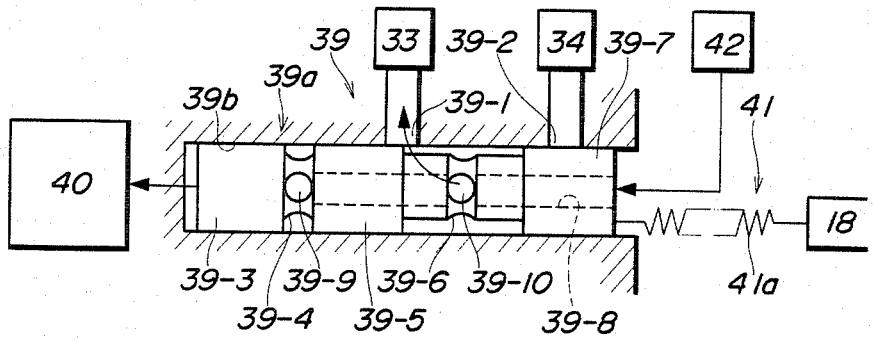
FIG. 5 is a view similar to FIG. 4, wherein the control valve is in a displacement-increasing position.
Figure 6:
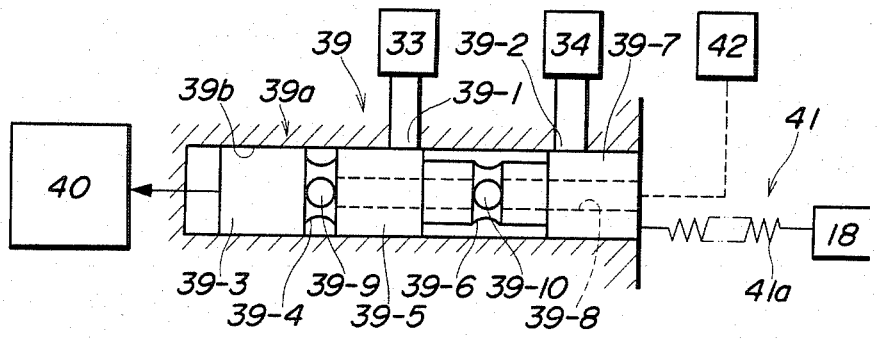
FIG. 6 is a view similar to FIG. 4, wherein the control valve is in a displacement-maintaining position.
Figure 7:
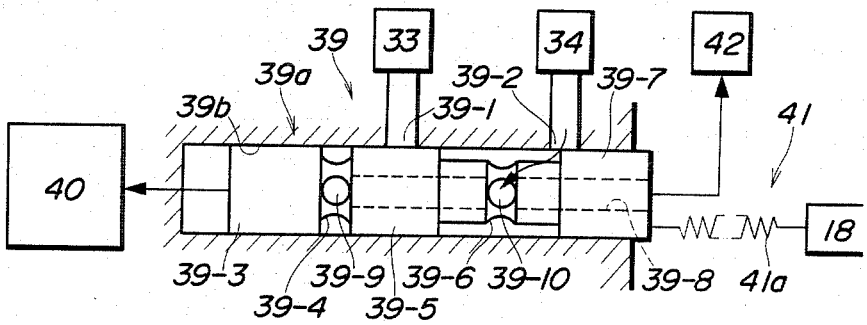
FIG. 7 is a view similar to FIG. 4, wherein the control valve is in a displacement-decreasing position.

Next, when the power switch of the air conditioner is turned on, the electronic control unit ECU is actuated in response to an input parameter signal to apply a control signal to the solenoid 40 to energize same to cause displacement of the spool 39*a* into a displacement-increasing position as shown in FIG. 5. In this position, the third land 39-7 of the spool 39*a* blocks the second port 39-2 leading to the discharge chamber 34, 30 and the suction chamber 33 communicates with the crankcase 42 through the internal bore 39-8, the fourth port 39-10, the second annular groove 39-6 and the first port 39-1. On the other hand, when the power switch is turned on, usually the wobble plate 20 is rotating. Since the pistons 26 are then already allowed for reciprocating motions through a slight strokelength as noted above, suction pressure and discharge pressure are appreciably produced in the suction chamber 33 and the discharge chamber 34 immediately upon the start of rotation of the wobble plate 20 in such a manner that suction of refrigerant gas from the suction chamber 33 into the cylinders 14 through the suction valves and discharge of the same gas from the cylinders into the discharge chamber 34 take place alternately in unison with the reciprocating motions of the pistons 26 in the cylinders 14. When the discharge pressure increases beyond the setting force of the spring of the check valve 34*a* in the discharge chamber 34, the same valve is opened to allow the compressed refrigerant gas to be discharged into the refrigerating circuit. Simultaneously, the suction pressure is developed to cause a drop in the pressure in the crankcase 42. Consequently, the difference becomes larger between the reaction force produced by the compressing action of the pistons 26 and the pressure in the crankcase 42 acting upon the pistons 26 as back pressure, which causes pivotal displacement of the wobble plate 20 to a larger angle of inclination relative to the drive shaft 13 to increase the displacement of the pistons 26. The wobble plate 20 reacts quickly because the discharge pressure in the small volume between the pistons and the check valve increases quickly. This happens before the suction pressure drops very much. With the increase of the angularity of the wobble plate 20, the slider 18 is displaced in a direction away from the spool valve 39 to render the feedback spring 41*a* taut so that the spring 41*a* pulls and displaces the spool 39*a* in a direction away from the solenoid 40 against the force of the latter into a position as shown in FIG. 6, wherein the second land 39-5 and third land 39-7 of the spool 39*a* block the first port 39-1 and the second port 39-2, respectively. The spool 39*a* stops at this position. With the spool 39*a* in this position, the displacement of the pistons 26 is kept constant, with the wobble plate 20 kept at a certain angle of inclination to the drive shaft 13. The above angle of inclination of the wobble plate 20 depends upon the relationship between the degree of energization of the solenoid 40 corresponding to its input control signal and the pulling force of the feedback spring 41*a*. That is, if the control signal inputted to the solenoid 40 has a large value, the wobble plate 20 becomes stationary in a large angularity position wherein the displacement of the compressor is large, whereas if the control signal has a small value, the wobble plate 20 becomes stationary in a small angularity position wherein the displacement is small. When the pressure in the crankcase 42 increases due to an increase in the amount of blowby gases caused by an increase in the rotational speed of the drive shaft 13 or due to an increase in the suction pressure caused by increased thermal load on the refrigerating circuit, the wobble plate 20 is pivotally displaced to a smaller angle of inclination, and the slider 18 is correspondingly moved toward the spool valve 39. Consequently, the spool 39*a* moves back toward the solenoid 40 to open the first port 39-1 to establish communication between the crankcase 42 and the suction chamber 33, resulting in a decrease in the crankcase pressure and consequently an 15 increase in the angularity of the wobble plate 20. On the contrary, when the crankcase pressure decreases due to a decrease in the amount of blow-by gases or a decrease in the suction pressure caused by decreased thermal load, the wobble plate 20 is pivotally displaced to an increased angle of inclination to move the slider 18 in the direction away from the 20 spool valve 39. The resulting increased force of the feedback spring 41*a* causes the spool valve 39*a* to be displaced toward the slider 18 so that the second port 39-2 is opened to establish communication between the crankcase 42 and the high pressure discharge chamber 34 as shown in FIG. 7. Consequently, the pressure in the crankcase 42 is instantly increased to rapidly reduce the angularity of the wobble plate 20. In the above-described manner, the displacement or capacity of the compressor is maintained at a constant value.

If it is desired to reduce the capacity of the compressor, the degree of energization of the solenoid 40 is decreased to displace the spool 39*a* in the displacement-decreasing position as shown in FIG. 7 wherein the first port 39-1 leading to the suction chamber 33 is blocked and communication is made between the crankcase 42 and the discharge chamber 34 through the internal bore 39-8, the fourth port 39-10, the second annular groove 39-6 and the second port 39-2. The high discharge pressure in the chamber 34 is immediately introduced into the crankcase 42 to rapidly reduce the angularity of the wobble plate 20 and consequently the capacity of the compressor.

The parameters that can be used for control of the angularity of the wobble plate 20 can include refrigerant temperature and pressure A at the outlet of the evaporator or at the inlet of the compressor, passenger compartment temperature B, ambient temperature C, air-mix damper opening D, sunshine E, engine cooling water temperature F, intake manifold pressure G, accelerator operating rate H, condenser temperature and pressure I, passenger number J and crankcase pressure K, which are shown in FIG. 8 as inputs to the electronic control unit ECU.

A signal indicative of at least one of these parameters A–K is inputted to the electronic control unit ECU which in turn processes the signal to supply a control signal corresponding to the input signal to the solenoid 40 for energization of same. By the use of the above parameters A–K, automatic control of the angularity of the wobble plate can be properly performed to maintain a comfortable air-conditioned ambience. More specifically, various excellent functions are available, which include: prevention of freezing of the evaporator, vacuum operation of the compressor, overheating of the engine, and frosting of the window panes of the passenger compartment; automatic load-dependent correction of the air conditioning capacity at engine acceleration and deceleration; and proper reduction of the compressor capacity at abnormally high temperature or pressure of the condenser.

Incidentally, the compressor of the invention may be arranged such that each of the pistons can start its suction stroke motion at an extreme end position in the cylinder 14 forming the top dead center of the piston even when the wobble plate 20 is in its minimum angularity position, by virtue of the arrangement of the wobble plate 20 being pivoted to the pivot 21 which is radially spaced from the drive shaft 13. With such arrangement, the compressing space in the cylinder 14 can have a small volume to keep sufficient compression efficiency even when the wobble plate 20 has small angularity and consequently the displacement is small.

According to the control valve arrangement stated above, the direct introduction of high discharge pressure into the crankcase for reduction in the displacement enables the angularity of the wobble plate to be varied with high responsiveness. For instance, when it is desired to use all the output power of the engine for driving the automotive vehicle in acceleration or in the event that the vehicle is running on an ascending slope, the response time required for cutting off the operation of the compressor can be 0.5 sec. or less.

The feedback means operable to detect the actual angularity of the wobble plate for direct feedback to the control valve provides automatic control of the wobble plate angularity over a wide range of conditions.

While a preferred embodiment has been described, variations thereto will occur to those skilled in the art within the scope of the present inventive concepts which are delineated by the following claims.

What is claimed is:

1. In a wobble plate compressor comprising a housing having a crankcase, a suction pressure space and a discharge pressure space formed therein, a drive shaft rotatably disposed in said housing, a cylinder block disposed in said housing and formed therein with a plurality of cylinders circumferentially arranged around said drive shaft and extending substantially parallel to the axis of said drive shaft, said cylinders each being arranged to have an interior thereof communicate with said suction pressure space and said discharge pressure space, pistons received in said cylinders for reciprocating motions therein, a wobble plate disposed in said crankcase and fitted on said drive shaft for rotation in unison therewith, a first pivot supporting said wobble plate at a peripheral edge thereof for causing pivotal movement of same about said first pivot, said first pivot being spaced radially from said drive shaft and rotatable about the axis of said drive shaft in unison therewith, a second pivot supporting said wobble plate at a central portion thereof and axially movable along said drive shaft, said pistons engaging said wobble plate for reciprocating motions in said cylinders thereof as said wobble plate rotates, said wobble plate having an angle of inclination thereof relative to said drive shaft variable about said first pivot for varying displacement of said pistons, depending upon the difference between resultant reaction force exerted by said pistons on compression strokes thereof and pressure in said crankcase acting upon said pistons as back pressure, and elastic means permanently applying biasing force to said wobble plate in a direction of decreasing the angle of inclination of said wobble plate;

the improvement comprising control valve means responsive to a signal indicative of at least one predetermined parameter to selectively connect said crankcase with either or both of said suction pressure space and said discharge pressure space, to decrease the pressure in said crankcase for an increase in the angle of inclination of said wobble plate when said crankcase is connected with said suction pressure space and to increase the crankcase pressure for a decrease in the angle of inclination of said wobble plate when said crankcase is connected with said discharge pressure space wherein said pistons are disposed to make reciprocating motions through a slight stroke length sufficient for producing, respectively, in said suction pressure space and said discharge pressure space suction pressure and discharge pressure required for said control valve means to vary the angle of inclination of said wobble plate, when said wobble plate assumes a predetermined minimum angle of inclination relative to said drive shaft, and said control valve means establishes a closed circuit formed by said crankcase, said suction pressure space and said discharge pressure space to enable said pistons to make reciprocating motions through said slight stroke length.

2. The wobble plate compressor as claimed in claim 1, wherein said control valve means comprises: a spool valve having a spool displaceable for selective communication of said crankcase with either or both of said suction pressure space and said discharge pressure space; solenoid means substantially directly connected to said spool for driving same and operable when energized to displace said spool of said spool valve in a direction of establishing communication of said crankcase with said suction pressure space; feedback means operable to displace said spool of said spool valve in a direction of establishing communication of said crankcase with said discharge pressure space, said feedback means having force variable in substantially direct response to the angle of inclination of said wobble plate, for displacing said spool against a force caused by energization of said solenoid means; and electronic means for energizing said solenoid with a magnitude corresponding to the value of said parameter-indicative signal.

3. The wobble plate compressor as claimed in claim 2, wherein said feedback means comprises a tension spring connected between said spool of said spool valve and said second pivot.

4. The wobble plate compressor as claimed in any one of claims 1, 2 or 3, including a check valve arranged at an outlet of said discharge pressure space for opening when pressure in said discharge pressure space exceeds a predetermined value.

* * * * *